US012037215B2

(12) United States Patent
Alpan et al.

(10) Patent No.: US 12,037,215 B2
(45) Date of Patent: Jul. 16, 2024

(54) HOOK AND LOOP DISPENSER

(71) Applicant: Klein Tools, Inc., Lincolnshire, IL (US)

(72) Inventors: Karen Alpan, Elmhurst, IL (US); Jace Mattson, Chicago, IL (US); Sean O'Flaherty, Kenosha, WI (US); John Gibbons, Palatine, IL (US)

(73) Assignee: Klein Tools, Inc., Lincolnshire, IL (US)

( * ) Notice: Subject to any disclaimer, the term of this patent is extended or adjusted under 35 U.S.C. 154(b) by 268 days.

(21) Appl. No.: 17/358,826

(22) Filed: Jun. 25, 2021

(65) Prior Publication Data

US 2022/0411221 A1 Dec. 29, 2022

(51) Int. Cl.
*B65H 35/00* (2006.01)

(52) U.S. Cl.
CPC ..... *B65H 35/0073* (2013.01); *B65H 35/002* (2013.01)

(58) Field of Classification Search
CPC ..... B65H 35/002; B65H 35/0073; B65H 35/0026; B65H 35/0033; B65H 2301/5154
See application file for complete search history.

(56) References Cited

U.S. PATENT DOCUMENTS 2,352,445 A 6/1944 Pinckney
2,581,190 A 1/1952 Hodges
2,698,143 A 12/1954 Pottle
2,727,572 A * 12/1955 Di Carlo ..... B65H 35/008 24/561
3,186,892 A * 6/1965 Walthers ..... B65H 35/0033 242/588
4,306,477 A * 12/1981 Travis ..... B26D 5/26 83/205
4,996,901 A 3/1991 Fullerton
5,107,734 A * 4/1992 Armbruster ..... A47K 10/3612 83/205
5,257,711 A * 11/1993 Wirtz-Odenthal ..... A47K 10/3643 225/72
5,326,421 A * 7/1994 Taylor ..... B65H 35/0033 156/577
6,113,293 A * 9/2000 Schanke ..... B65H 35/0086 400/621
6,152,344 A 11/2000 Jensen
6,170,726 B1 * 1/2001 Jensen ..... B65H 35/0026 225/23
6,705,373 B1 * 3/2004 Yu Chen ..... B65H 35/0086 156/577
6,789,594 B1 * 9/2004 Yu Chen ..... B65H 35/0026 225/56
7,320,351 B2 * 1/2008 Chern ..... B65H 35/0033 156/577
10,676,307 B1 * 6/2020 Mallahan, III ..... B65H 35/008
(Continued)

*Primary Examiner* — Evan H MacFarlane
*Assistant Examiner* — Fernando A Ayala

(57) ABSTRACT

A device for dispensing hook and loop material includes a housing configured to support a roll of hook and loop material, a carriage mounted on the housing to move between a first position and a second position, and a cutting mechanism mounted to the carriage for movement therewith. The cutting mechanism is configured to cut the hook and loop material at the first position and create a cut end. The cutting mechanism is configured to expose a length of hook and loop material and the cut end at the second position.

10 Claims, 6 Drawing Sheets

(56) References Cited

U.S. PATENT DOCUMENTS

| | | | | |
|---|---|---|---|---|
| 2007/0169601 | A1* | 7/2007 | Yu | B23D 23/00 83/613 |
| 2008/0067211 | A1* | 3/2008 | Steele | B65H 35/0073 156/577 |
| 2009/0178767 | A1* | 7/2009 | Shen | B65H 35/0086 156/510 |
| 2011/0048647 | A1* | 3/2011 | Liu | B65H 35/008 156/527 |
| 2012/0018087 | A1* | 1/2012 | Hu | B65H 35/0086 156/523 |
| 2017/0057674 | A1* | 3/2017 | Myers | B26D 7/14 |
| 2020/0270086 | A1* | 8/2020 | Jones | B65H 35/002 |
| 2022/0135361 | A1* | 5/2022 | Verrall | B65H 35/0086 156/64 |
| 2022/0185611 | A1* | 6/2022 | Jang | B26D 1/045 |

* cited by examiner

HOOK AND LOOP DISPENSER

BACKGROUND OF THE DISCLOSURE

The present disclosure relates to dispensing hook and loop material, and more particularly, cutting and dispensing hook and loop material to varying lengths. Hook and loop material, also known as hook and loop fasteners, hook and pile fasteners, or touch fasteners, typically includes a fabric strip with small hooks on one side of the material and small loops on another side of the material. When a portion of hook and loop material with the small loops is pressed together with a portion of hook and loop material with the small loops, the hooks catch the loops to releasably attach the two sides. The material may be separated by pulling the hooks and loops away from each other. Hook and loop material may come in rolls of long lengths of material, and it may be desirable to cut to shorter lengths.

BRIEF SUMMARY OF THE DISCLOSURE

In accordance with one feature of this disclosure, a device for dispensing hook and loop material is provided and includes a housing configured to support a roll of hook and loop material, a carriage mounted on the housing to move between a first position and a second position, and a cutting mechanism mounted to the carriage for movement therewith. The cutting mechanism is configured to cut the hook and loop material at the first position and create a cut end. The cutting mechanism is configured to expose a length of hook and loop material and the cut end at the second position.

In one feature, the cutting mechanism further includes a blade and a handle. The blade is actuated by the handle at the first position to cut the hook and loop material and create the cut end.

According to another feature, the housing includes a stop surface, and the cutting mechanism comprises a mating surface. At the second position, the stop surface engages the nub to prevent the handle from actuating the blade.

As one feature, the housing includes a channel, the carriage includes a rib, and the rib engages the channel to mount the carriage to the housing.

In one feature, the device for dispensing hook and loop material further includes a material guide and a pivotably mounted pawl configured to create an adjustable opening between the material guide and the pawl. A portion of the hook and loop material can be located in the opening between the material guide and the pawl. The pawl engages the hook and loop material to prevent the hook and loop material from moving backwards relative to the cutting mechanism.

According to one feature, the pawl is pivotable to an open pawl position to allow the hook and loop material to move freely though the opening.

As one feature, there is clearance in the cutting mechanism for the hook and loop material to pass through freely as the carriage translates between the first position and the second position.

In one feature, the device for dispensing hook and loop material further includes a roll support attached to the housing and configured to support the hook and loop material and a roll cap removably attached to the roll support. The roll support is configured to allow the hook and loop material to rotate to dispense the hook and loop material.

According to one feature, the carriage may be mounted on the housing to translate between the first and second positions.

As one feature, the housing comprises a pair of elongated channels and the carriage comprises a pair elongate ribs located on opposite sides of the carriage. Each of the ribs is slidably received in a corresponding one of the channels for guided movement relative to the housing.

In accordance with one feature, a device for dispensing hook and loop material includes a housing configured to support a roll of hook and loop material and a cutting mechanism configured to translate along the housing between a first position and a second position. The cutting mechanism is configured to cut the hook and loop material at the first position and create a cut end, and the cutting mechanism is configured to expose a length of hook and loop material and the cut end at the second position.

In one feature, the housing includes a channel, and the cutting mechanism includes a rib slidably received in the channel for guided translation relative to the housing.

According to one feature, the housing comprises a mounting clip or a magnet.

In accordance with one feature, a method for dispensing material of varying lengths includes supporting a roll of hook and loop material on a housing of a hook and loop dispenser and cutting the hook and loop material to create a cut end with a cutting mechanism mounted to the housing at a first position. The cutting mechanism is configured to slide relative to the housing between the first position and a second position. The method further includes sliding the cutting mechanism to the second position to expose the cut end and pulling the hook and loop material to dispense a length of hook and loop material from the roll of hook and loop material.

It should be understood that the inventive concepts disclosed herein do not require each of the features discussed above, may include any combination of the features discussed, and may include features not specifically discussed above.

DETAILED DESCRIPTION OF PREFERRED EMBODIMENTS

Figure 1:
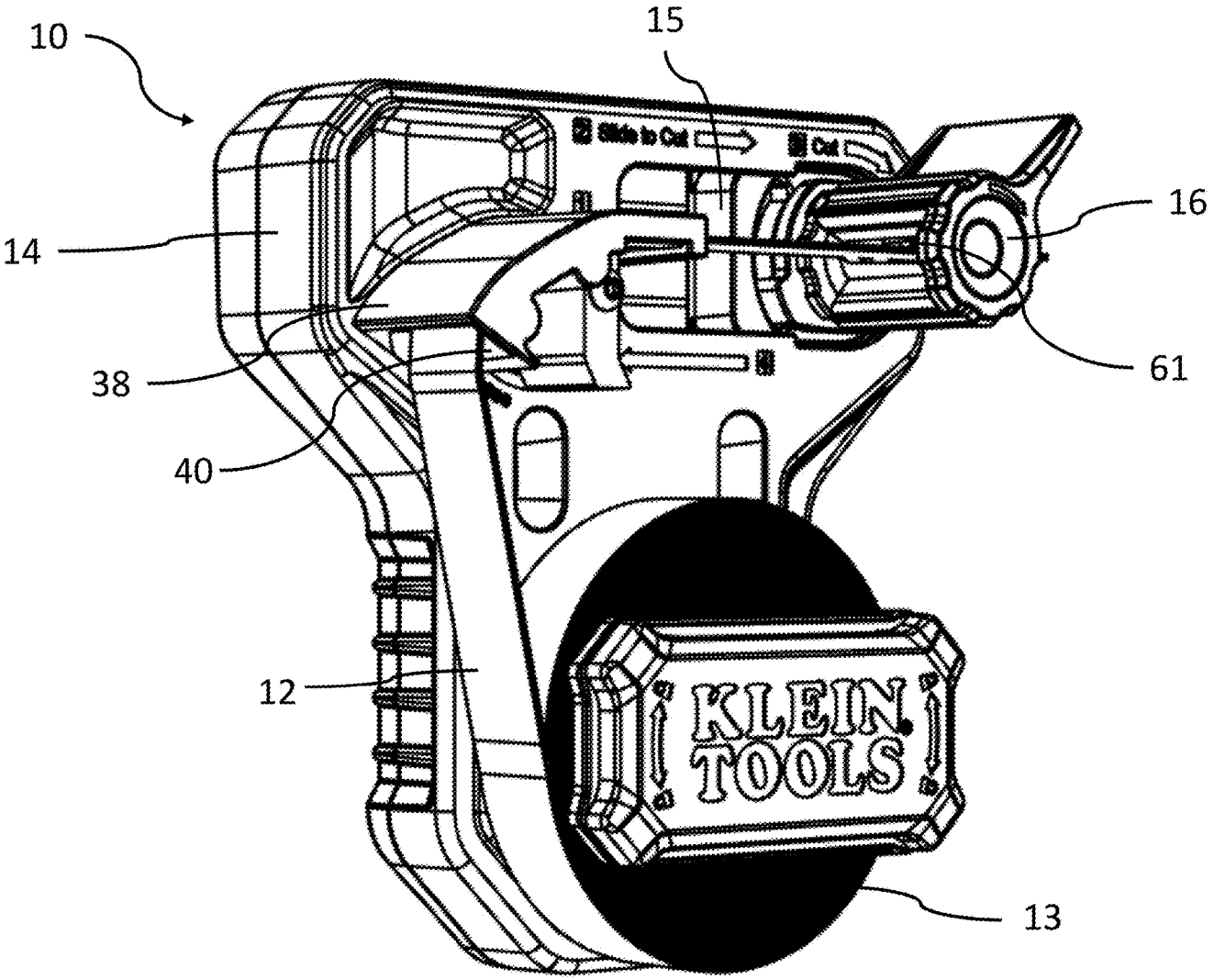
FIG. 1 is a perspective view from the front and side of a hook and loop dispenser carrying a roll of hook and loop material.
Figure 2:
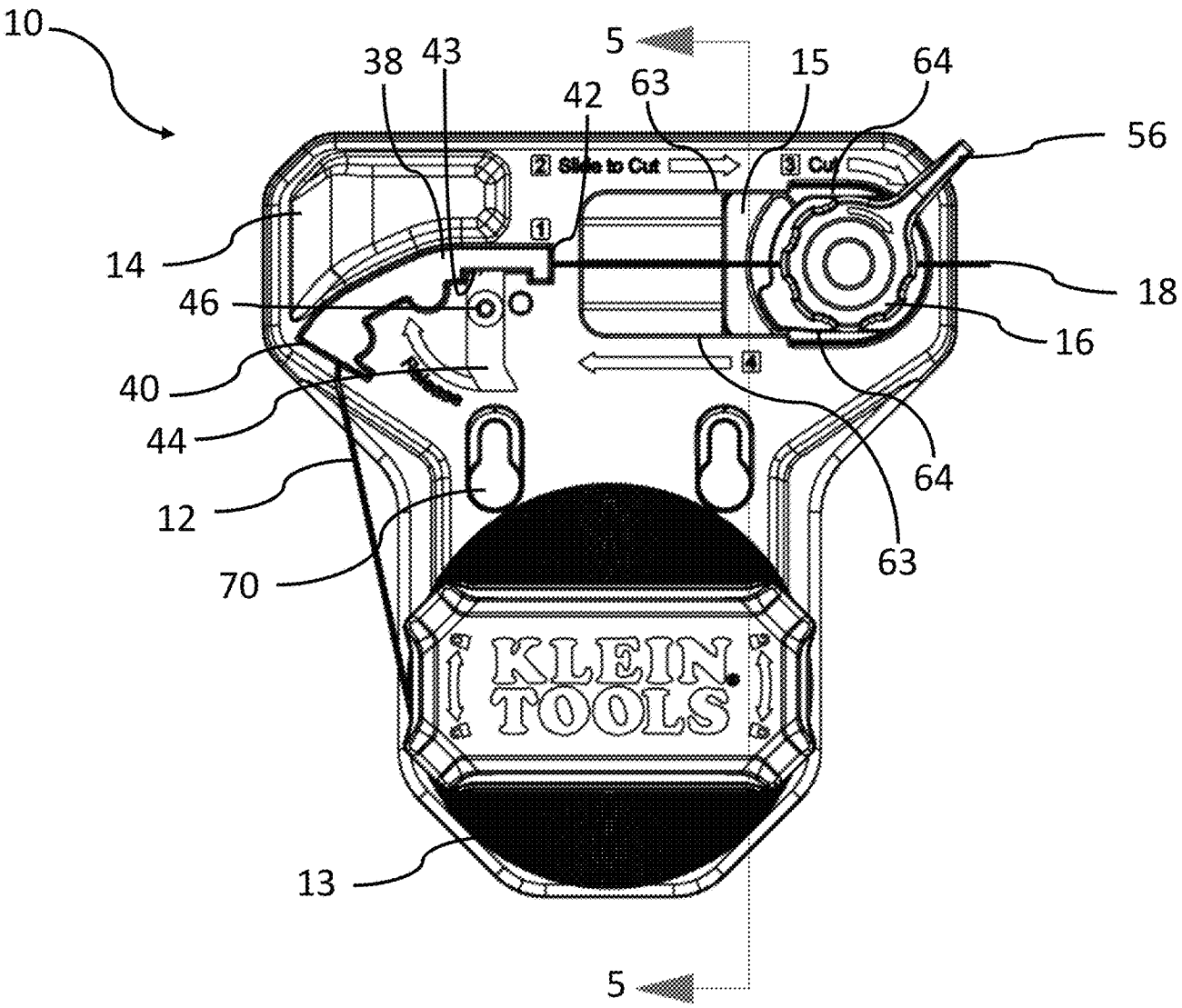
FIG. 2 is a front view of the hook and loop dispenser of FIG. 1 with a cutting mechanism in a first position.
Figure 3:
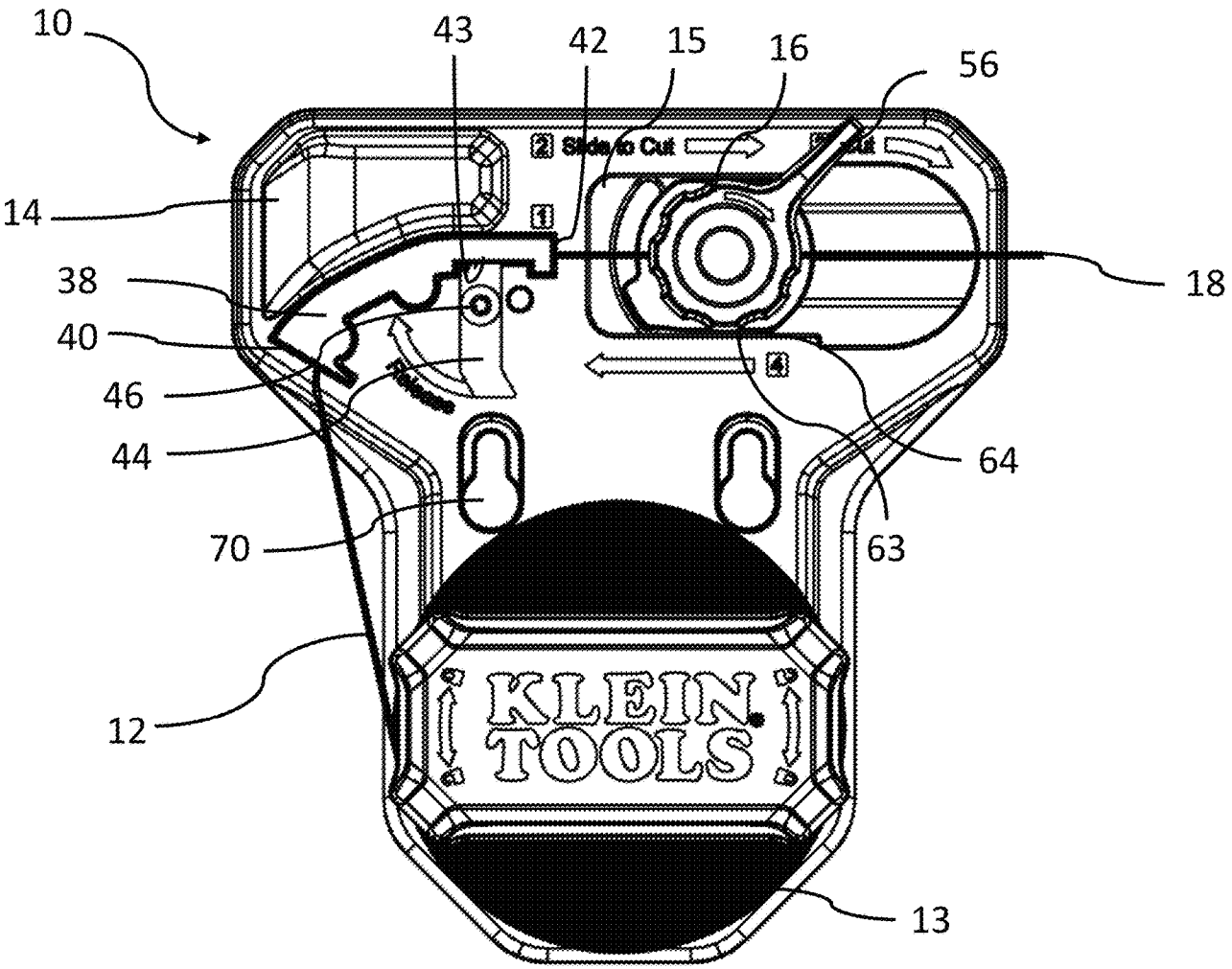
FIG. 3 is a front view of the hook and loop dispenser of FIG. 1 with the cutting mechanism in a second position.

As best seen in FIGS. 1-3, a hook and loop material dispenser 10 is provided to dispense a strip of hook and loop material 12 from a roll 13 of the hook and loop material 12. The material dispenser 10 includes a housing 14 configured to support the roll 13 of hook and loop material 12. The dispenser 10 includes a carriage 15 that is mounted on the housing 14 to move relative to the housing 14. A cutting mechanism 16 is attached to the carriage 15 to move therewith relative to the housing 14.

In the illustrated and preferred embodiment, the carriage 15 is mounted to slide (e.g., translate) between at least a first position shown in FIGS. 1 and 2, and a second position shown in FIG. 3. For purposes of terminology, as illustrated in FIG. 2, the first position is a forward (e.g., front, cutting) position and is used for cutting the hook and loop material 12 to separate a desired length of the hook and loop material 12 from the roll 13 and to create a cut end 18 (e.g., cut edge) on the hook and loop material 12 that extends from the roll 13. For purposes of terminology, as illustrated in FIG. 3, the second position is a rearward (e.g., rear, back, unreel) position and is be used to expose the cut end 18 of the hook and loop material 12 so that a user can grasp the cut end 18 to dispense another desired length of the hook and loop material 12 from the roll 13.

Figure 4:
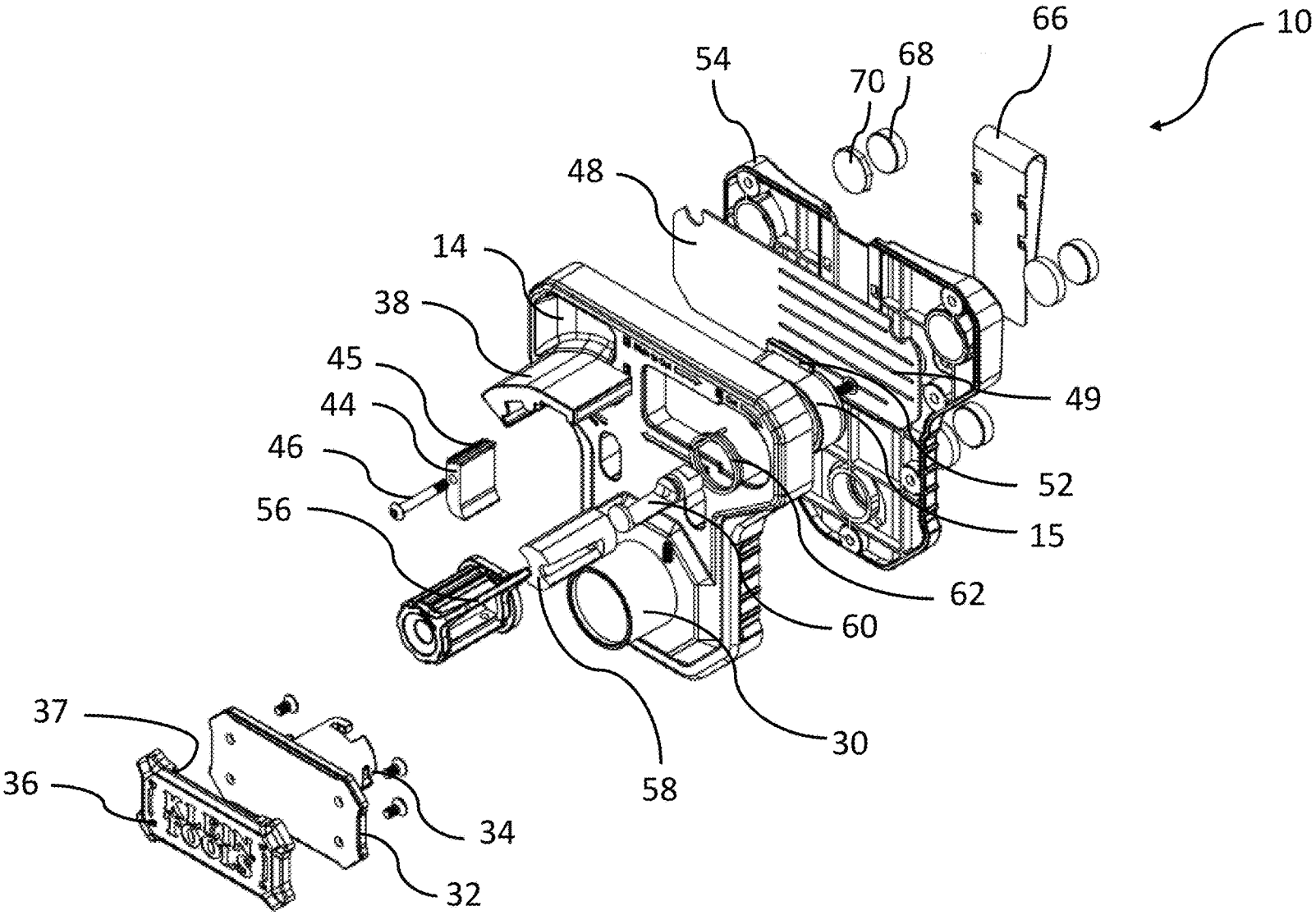
FIG. 4 is an exploded view of the hook and loop dispenser of FIG. 1.

An exploded view of the material dispenser 10 is shown in FIG. 4. The material dispenser 10 has a housing 14 (e.g., main housing), and a roll support 30 is attached to the housing 14. The roll support 30 is a cylindrical support for mounting the roll 13 of hook and loop material 12 thereon. The roll 13 has a cylindrical core that is removably mounted onto the roll support 30 and that rotates relative to the support 30 and housing 14 to allow hook and loop material 12 to be dispensed from the roll 13.

The material dispenser 10 has a roll cap 32 removably attached to the roll support 30. The roll cap 32, while affixed to the roll support 30, prevents the roll 13 from purposefully and/or accidentally being removed from the roll support 30. An attachment portion of the roll cap 32 attaches to an inside portion the roll support 30. In the illustrated embodiment, the attachment is provided in the form of a bayonet type connection and the roll cap 32 comprises one or more roll cap notches 34 configured to clip onto/into corresponding roll support notches (not shown) on the interior of the roll support 30. A front plate 36 (e.g., logo plate, design plate) is permanently or removably attached to the roll cap 32. The front plate has a cutout notch 37 providing a gap between the roll cap 32 and the front plate 36. The gap created by the cutout notch 37 allows for a cut piece of hook and loop material 12 to pass therethrough. The cut piece of hook and loop material 12 may, for example, be looped around the front plate 36 and attached to itself to be saved for later use. The front plate 36 also allows for the addition of logos or other design details to the roll cap 32.

The material dispenser 10 includes a material guide 38 to guide (e.g., direct) the hook and loop material 12 from the roll 13 of hook and loop material 12 and towards the cutting mechanism 16. As best shown in FIGS. 1-3, the hook and loop material 12 travels from the roll 13 of hook and loop material 12 and enters a first opening 40 (e.g., rear opening) of the material guide 38. The hook and loop material 12 exits the material guide 38 at a second opening 42 (e.g., forward opening). In the preferred embodiment, the second opening 42 opens towards the cutting mechanism 16 and is configured to direct the hook and loop material 12 towards the cutting mechanism 16 as the hook and loop material 12 exits the material guide 38. The material guide 38 includes a pawl 44 that forces the hook and loop material 12 against a surface 43 of the material guide 38 that extends from the first opening 40 to the second opening 42. In this regard, the pawl 44 comprising a ridged or toothed engagement surface 45 that frictionally engages against a bottom side the hook and loop material 12 to force a top side of the hook and loop material 12 into frictional engagement with the surface 43. In the illustrated embodiment, the pawl 44 is attached to the housing 14 by a pawl screw 46, and the pawl 44 pivots relative to the housing 14 on the pawl screw 46. The pawl 44 engages the hook and loop material 12 to prevent the hook and loop material 12 from moving away from the cutting mechanism 16. The pawl 44 is configured to pivot based on the direction the hook and loop material 12 is pulled. The top of the pawl 44 pivots clockwise in FIGS. 1-3 towards the cutting mechanism 16 when a user pulls the hook and loop material 12 towards the cutting mechanism 16, allowing the user to freely dispense the hook and loop material 12. The pawl 44 is configured such that if the top of the pawl 44 pivots counterclockwise in FIGS. 1-3 away from the cutting mechanism 16, the pawl 44 increasingly engages the hook and loop material 12 against the surface 43 of the material guide 38, holding and preventing the hook and loop 12 material from moving away from the cutting mechanism 16. For example, rotation of the roll 13 counterclockwise in FIGS. 1-3 will pull the hook and loop material 12 away from the cutting mechanism 16 and towards the material guide 38, thereby causing the engagement surface 45 of the pawl 44 to increasingly engage the hook and loop material 12 against the surface 43 of the guide 38. The pawl 44 engaging the hook and loop material 12 causes the pawl 44 to rotate, pivoting the top of the pawl 44 towards the surface 43 of the material guide 38, closing the gap between the pawl 44 and the surface 43 and pinning the hook and loop 12 material between the surface 43 and the pawl 44 to prevent the hook and loop 12 material from passing through freely. The pawl 44 may be manually rotated to an open position (e.g., rotate the top of pawl clockwise in FIGS. 1-3 towards the cutting mechanism 16) or to a closed position. The pawl 44 in the open position allows the hook and loop material 12 to move freely through the opening between the pawl 44 and the material guide 38 in either direction. The pawl 44 in the closed (e.g., upright) position is configured to prevent the hook and loop material 12 from moving freely through the opening between the pawl 44 and the material guide 38 and may only allow movement of the hook and loop material 12 towards the cutting mechanism 16.

Figure 5:
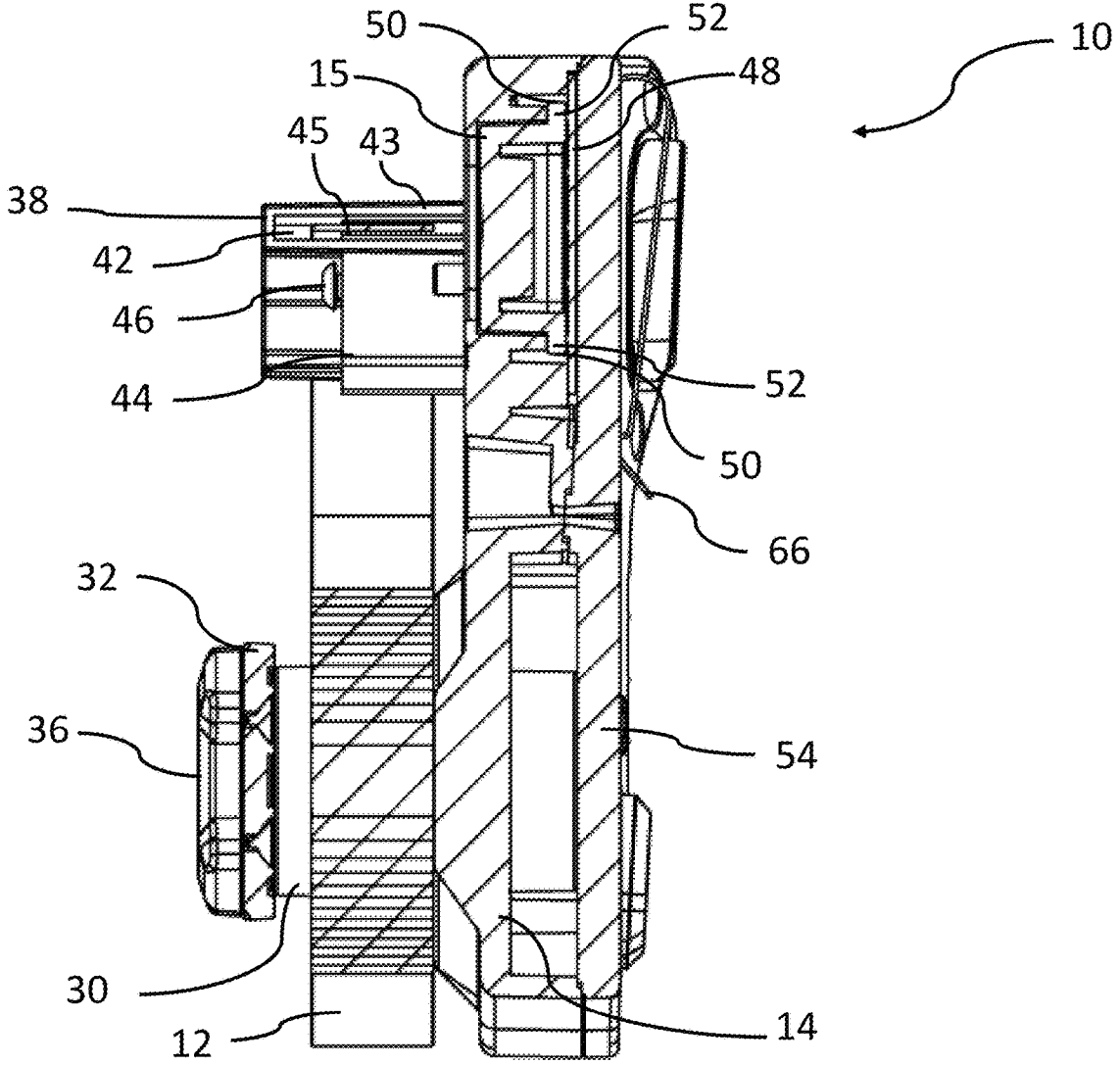
FIG. 5 is a section view taken along line 5-5 in FIG. 2.

The carriage 15 can be attached to the housing 14 by any suitable means of slidable attachment. As best shown in FIG. 5, in the illustrated embodiment, the material dispenser 10 includes a slide plate 48 located between the housing 14 and a back cover 54. The slide plate 48, for example, provides a low friction surface 49 for the carriage 15 to move/translate thereon. The housing 14 and the slide plate 52 form two opposed channels 50 therebetween, and the carriage 15 comprises two ribs 52. The ribs 52 are slidably received in the channels 50 to allow the carriage 15 to translate along the housing 14 and the slide plate 48 between the forward and rearward positions.

As best shown in FIGS. 1-3, the cutting mechanism 16 is attached to the carriage 15 and includes a handle 56 and a blade 58 that is actuated by the handle 56 to cut the hook and loop material 12 to create the cut end 18. In some examples, the cutting mechanism 16 may be integrated with the carriage 15.

While any suitable cutting mechanism, many of which are known, can be used in the material dispenser 10, in the illustrated embodiment, the cutting mechanism 16 includes the handle 56, the blade 58 in the form of a rotatable blade 58 (e.g., turning blade, rotatable cutting blade), and a fixed blade 60 (e.g., fixed cutting blade). The rotatable blade 58 is located in an interior of the handle 56. The cutting mechanism 16 has an opening 61 (best seen in FIG. 1) therein to allow the hook and loop material 12 to pass freely therethrough. The handle 56 rotates the rotatable blade 58 from an open position to a cutting position to cut the hook and loop material 12 with the rotatable blade 58 and the fixed blade 60. A spring 62 biases the rotatable blade 58 to the open position. The rotatable blade 58 of the illustrated embodiment includes a straight cutting edge to achieve a straight cut across the hook and loop material 12 that is perpendicular to the longitudinal extending sides of the hook and loop material. While the illustrated embodiment shows the use of a rotatable blade 58 and a fixed blade 60, other configurations may use a single blade (e.g., rotatable blade 58) to cut the hook and loop material 12 without the use of a second blade (e.g., fixed blade 60).

The cutting mechanism 16, as discussed above, is slidable between at least two positions, a forward (e.g., first, cutting) position and a rearward (e.g., second, unreel) position. The material dispenser 10 is configured to cut the hook and loop material 12 with the cutting mechanism 16 in the forward position shown in FIG. 2. The cutting mechanism 16 has the opening 61 to allow the hook and loop material 12 to pass freely therethrough. For example, the cutting mechanism 16 has clearance therein between the rotatable blade 58 and the fixed blade 60 to allow the hook and loop material 12 to pass through. The cutting mechanism 16 cuts the hook and loop material 12 to create the cut end 18. In the illustrated embodiment, the cut end 18 of the hook and loop material 12 does not extend out of the cutting mechanism 16 while the carriage 15 and the cutting mechanism 16 are in the forward position, making it difficult for a user to pull out an additional length of hook and loop material 12 to cut. To allow the user to dispense the additional length of hook and loop material 12 from the roll 13 of hook and loop material 12, the user can translate the cutting mechanism 16 to the unreel/reward position shown in FIG. 3. The clearance within the cutting mechanism 16 allows the carriage 15 and cutting mechanism 16 to move without displacing the hook and loop material 12, allowing the hook and loop material 12 to pass therethrough as the carriage 15 and/or cutting mechanism 16 moves. As discussed above, the pawl 44 engages the hook and loop material 12 to prevent the hook and loop material 12 from moving backwards, away from the cutting mechanism 16 as the cutting mechanism 16 and the carriage 15 are translated from the forward position to the rearward position. As the user slides the cutting mechanism 16 from the forward position to the rearward position, the pawl 44 prevents movement of the hook and loop material 12 and the cut end 18 of the hook and loop material 12 is exposed, as shown in FIG. 3. The exposed cut end 18 allows the user to pull the cut end 18 to dispense a new length of hook and loop material 12 from the roll 13. In this regard, as the user applies a forward pulling motion to the hook and loop material 12, the pawl 44 pivots to an open position, allowing the hook and loop material 12 to pass therethrough, and dispensing additional hook and loop 12 material from the roll 13. After pulling out a desired length of hook and loop material 12, the user may slide the cutting mechanism 16 to the forward position to cut the hook and loop material 12 and create a new cut end 18.

As best shown in FIGS. 2-3, material dispenser 10 includes a cut stop which in the illustrated embodiment is provided in the form of a stop surface 63 on the housing 14 and a mating surface 64 on the cutting mechanism 16. In the illustrated and preferred embodiment, the housing 14 comprises the stop surface 63. The stop surface 63 is configured to prevent the cutting mechanism 16 from cutting the hook and loop material 12. The cutting mechanism 16 comprises the mating surface 64 configured to engage the stop surface 63, and the stop surface 63 engages the mating surface 64 to prevent the cutting mechanism 16 from rotating and cutting the hook and loop material 12 (e.g., prevent the handle 56 from actuating the rotatable blade 58) when the carriage 15 and the cutting mechanism 16 are in the rearward position. In the illustrated and preferred embodiment, the mating surface 64 is shown as a flat surface extending along a bottom portion of the cutting mechanism 16. The stop surface 63 engages the mating surface 64 when the carriage 15 and the cutting mechanism 16 are in the second position (e.g., rear, back, unreel position), as shown in FIG. 3. The stop surface 63 does not engage the mating surface 64 when the carriage 15 and the cutting mechanism 16 are in the forward position to allow the cutting mechanism 16 to cut the hook and loop material 12, as shown in FIG. 2. The stop surface 63 and mating surface 64 allow a user to slide the carriage 15 from the second position to the first position (e.g., forward) using the handle 56 without the cutting mechanism 16 actuating and cutting the hook and loop material 12 until the carriage 15 is in the first position (e.g., cutting position).

Figure 6:
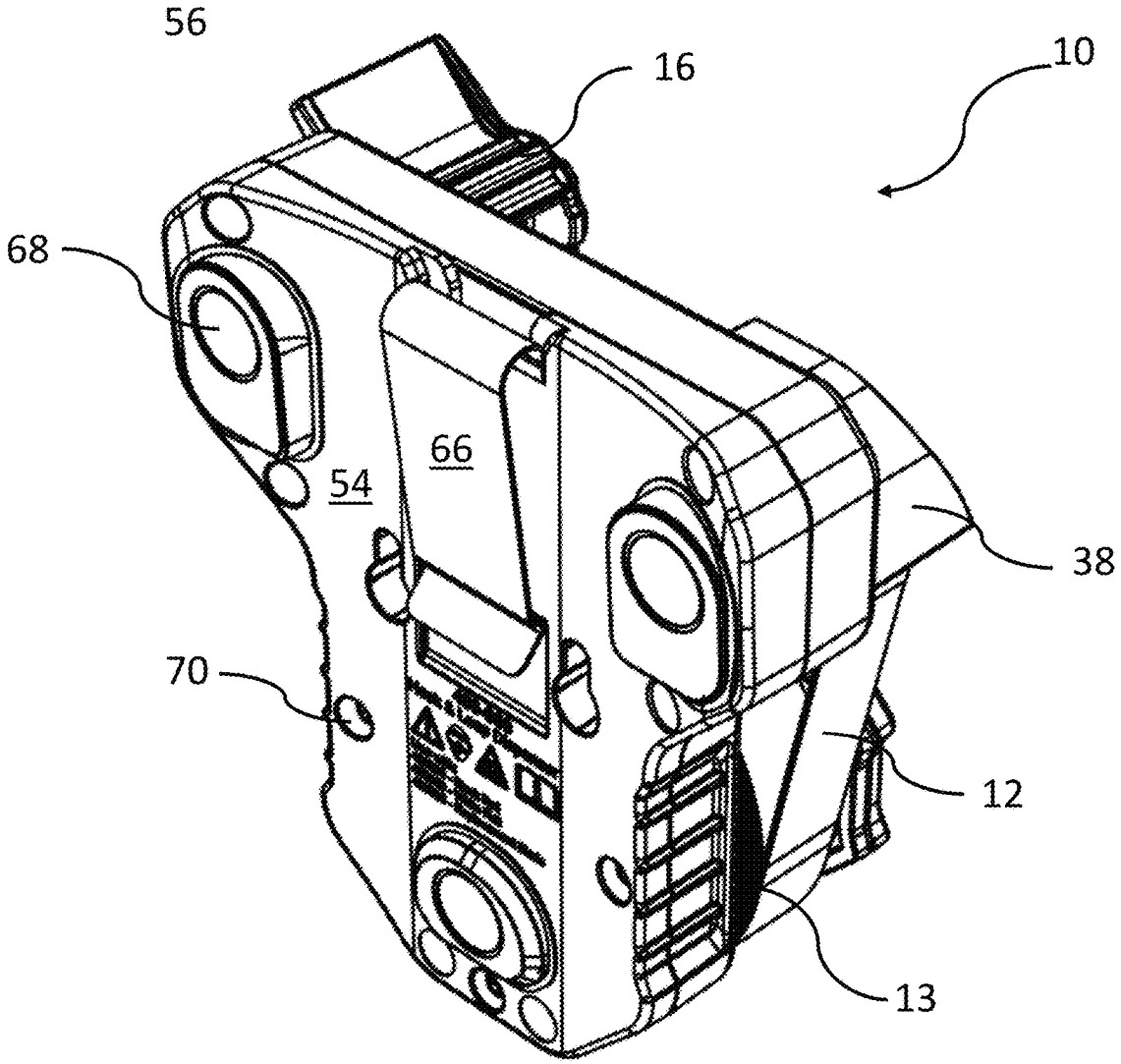
FIG. 6 is a perspective view from behind and above of the hook and loop dispenser of FIG. 1.

The material dispenser 10 may use any type of mounting/support structures, many of which are known, to mount or support the material dispenser 10. As shown in FIG. 6, the material dispenser 10 includes a clip 66 (e.g., mounting clip). The clip 66 is shown in the form of a belt clip attached to the back cover 54, allowing the material dispenser 10 to be attached to a user's belt. While the clip 66 is shown in the form of a belt clip, any form of clip may be used for mounting/supporting the material dispenser. The material dispenser 10 includes magnets 68 to support the material dispenser 10. The magnets 68 are disposed in the back cover 54 with magnet caps 70. The magnets 68 allow the material dispenser to be supported by and/or mounted onto ferromagnetic surfaces. The material dispenser 10 has screw holes 70 (e.g., keyhole screw slots) through the housing 14 to mount the material dispenser using screws. In the illustrated and preferred embodiment, the back cover 54 features a curved shape for improved wearability when mounted to a user's hip. The magnets 68 are located on the back cover 54 to form a flat plane to allow the material dispenser 10 to be optimally mounted to a flat surface using the magnets 68 or screw holes 70 without the clip 66 protruding past the flat plane formed by the magnets 68.

A user may use the material dispenser 10 to dispense hook and loop material 12 as follows. The roll 13 of hook and loop material 12 is supported by the housing 14 of the hook and loop dispenser 10. In the preferred method, the hook and loop material 12 is mounted onto the roll support 30. A length of the hook and loop material 12 is configured to pass from the roll 13 of hook and loop material 12, through the material guide 38, and to the cutting mechanism 16. A length of hook and loop material 12 may extend past the cutting mechanism 16, and the portion extending past the cutting mechanism 16 may be cut to create the cut end 18 with the cutting mechanism 16 in a first position (e.g., forward position). In the preferred method, it may be difficult to pull an additional length of hook and loop material 12 from the roll of hook and loop material 12 because the cut end 18 is inside the cutting mechanism 16. The user may slide the cutting mechanism 16 to the second position (e.g., rearward position) to expose the cut end 18 of the hook and loop material 12. The user may pull the exposed hook and loop material 12 to dispense a new length of hook and loop material 12 from the roll 13 of hook and loop material 12. After pulling the desired length of hook and loop material 12 from the roll 13, the user may return the cutting mechanism 16 to the first position to cut the new desired length of hook and loop material 12 and create a new cut end 18.

Preferred embodiments of the inventive concepts are described herein, including the best mode known to the inventor(s) for carrying out the inventive concepts. Variations of those preferred embodiments will become apparent to those of ordinary skill in the art upon reading the foregoing description. The inventor(s) expect skilled artisans to employ such variations as appropriate, and the inventor(s) intend that the inventive concepts can be practiced otherwise than as specifically described herein. Accordingly, the inventive concepts disclosed herein include all modifications and equivalents of the subject matter recited in the claims appended hereto as permitted by applicable law. Moreover, any combination of the above-described elements and features in all possible variations thereof is encompassed by the inventive concepts unless otherwise indicated herein or otherwise clearly contradicted by context. Further in this regard, while highly preferred forms of the material dispenser 10 are shown in the figures, it should be understood that this disclosure anticipates variations in the specific details of each of the disclosed components and features of the material dispenser and that no limitation to a specific form, configuration, or detail is intended unless expressly and specifically recited in an appended claim.

For example, while specific and preferred forms have been shown for cutting hook and loop material 12, other materials such as ribbon, tape, etc. may be used where it is desirable to cut said other materials to a desired length. While the roll support 30 is shown as a circular support, the roll support 30 may comprise different shapes such as, for example, square, octagonal, etc., depending on the material (e.g., hook and loop material) to be supported by the roll support 30. While the roll support 30 is shown as being fixed relative to the housing 14 to dispense hook and loop material 12 from the roll 13, in some examples the roll support 30 may be rotatable relative to the housing 14 and the roll 13 may rotate with the roll support 30 to dispense hook and loop material 12. While the front plate 36 is shown attached to the roll cap 32, in some examples the roll cap 32 and the front plate 36 may be of uniform construction.

As another example related to the roll support 30, any method or location of supporting hook and loop material 12 may be used. For example, while the roll support 30 is shown as being mounted on a bottom portion of the material dispenser 10 (e.g., below the material guide 38 and cutting mechanism 16), alternative methods or locations may be used. In some examples, the material dispenser 10 may comprise an inner compartment and the roll 13 of hook and loop material 12 may be mounted inside the material dispenser 10 (e.g., inside the housing 14). In other examples, the material dispenser may not have a roll support 30 and the roll 13 of hook and loop material 12 may not be mounted to the material dispenser 10.

As another example related to the material guide 38, the pawl 44 may be mounted in any location to engage the hook and loop material 12. In some examples, the material dispenser 10 may not have a pawl 44. For example, the material guide 38 may have a narrow opening therein for the hook and loop material 12 to pass therethrough. The narrow opening may provide sufficient grip to limit movement of the hook and loop material 12 while moving/translating the carriage 15 and cutting mechanism 16. While the pawl 44 may be shown as comprising one or more ridges, any other structure that engages the hook and loop material 12, such as bumps, may be used. In some examples, the pawl 44 may include a pawl spring (e.g., torsion spring) to bias the engagement surface 45 towards the surface 43 of the material guide 38. In some examples, the material guide 38 may comprise metal pins therein to decrease friction and prevent wear between the material guide 38 and hook and loop material 12.

As a further example related to the material dispenser 10, the carriage 15 may be slidably mounted directly to the housing 14, the back cover 54, and/or the slide plate 48. While the housing 14 and the slide plate 48 are shown to form two opposed channels 50, other configurations may be used. For example, more or less than two channels 50 may be used. In some examples, the channels 50 may be formed exclusively by the housing 14. In some examples, the channels 50 may be formed exclusively by the slide plate 52. In some examples, the channels 50 may be formed by the back cover 54. In some examples the channels 50 may be formed by the carriage 15 and the ribs 52 may be formed by the housing 14, slide plate 52, and/or back cover 54. While ribs 52 and channels 50 are shown, any method of slidably coupling the carriage 15 may be used. In some examples, the material dispenser 10 may have a spring to bias the carriage 15 towards either the front position or the second position (e.g., forwards or backwards). In such examples, a user may push against the spring to either dispense or cut the hook and loop material 12 as desired. While the material dispenser 10 is discussed as having a first position (e.g., for cutting) and a second position (e.g., for dispensing material), the material dispenser 10 may have more than two positions. For example, the material dispenser 10 may have a plurality of positions where the cutting mechanism 16 may cut the hook and loop material 12. In such examples, multiple cutting positions may be used to finely control the length of hook and loop material 12 to be cut.

As another example related to the cutting mechanism 16, while a rotatable blade 58 and a fixed blade 60 are shown, other cutting configurations may be used, many of which are known. For example, the cutting mechanism 16 may have a single blade. In some examples, the cutting blades may move linearly instead of rotating to cut the hook and loop material 12. While a straight cutting edge is shown on the rotatable blade 58, other shapes may be used as desired. For example, an arcuate blade may be used to create a curved cut end, and other shaped blades may be used as desired. In some examples, the cutting blades may be serrated and/or have cutting teeth to aid in cutting the hook and loop material 12. In some examples, the cutting mechanism 16 may be user replaceable. In some examples, the cutting mechanism 16 may comprise a spring to bias the cutting mechanism 16 towards an open position where the user pushes against the spring to cut the hook and loop material 12, while in other examples it may be desirable not to include a spring.

As a further example related to the material dispenser 10, many elements may desirably be of unitary or separate construction. In some examples, portions of the cutting mechanism 16 may be of unitary construction with the carriage 15. In some examples, the material guide 38 may be of unitary construction with the housing 14 and/or the back cover 54. In some examples, the slide plate 48 may be of unitary construction with the housing 14 and/or the back cover 54. In some examples, the housing 14 and the back cover 54 may be of unitary construction.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. The use of any and all examples, or exemplary language (e.g., "such as") provided herein, is intended merely to better illuminate the inventive concepts disclosed herein and does not pose a limitation on the scope of any invention unless expressly claimed. No language in the specification should be construed as indicating any non-claimed element as essential to the practice of the inventive concepts disclosed herein.

What is claimed is:

1. A device for dispensing hook and loop material comprising:

a housing configured to support a roll of hook and loop material;

a carriage mounted on the housing to slide linearly between a first position and a second position; and a cutting mechanism including:

an interior having an opening to allow the hook and loop material to pass through the opening;

a fixed blade fixed in the interior; and a rotatable blade mounted to rotate relative to the fixed blade, the rotatable blade mounted within the interior of the cutting mechanism;

wherein the cutting mechanism is mounted to the carriage for movement therewith between the first position and the second position;

wherein the rotatable blade rotates to cut the hook and loop material to create a cut end on the hook and loop material with the carriage in the first position; and wherein the cutting mechanism is configured to expose a length of hook and loop material and the cut end with the carriage in the second position.

2. The device of claim 1, wherein:

the cutting mechanism comprises a handle; and the rotatable blade is actuated by the handle to cut the hook and loop material and create the cut end with the carriage in the first position.

3. The device of claim 2, wherein:

the housing comprises a stop surface;

the cutting mechanism includes a mating surface; and with the carriage in the second position, the stop surface engages the mating surface to prevent the handle from actuating the rotatable blade.

4. The device of claim 2, wherein:

the housing comprises a channel;

the carriage comprises a rib; and the rib engages the channel to mount the carriage to the housing.

5. The device of claim 1, further comprising:

a material guide; and a pivotably mounted pawl configured to create an adjustable opening between the material guide and the pawl;

wherein a portion of the hook and loop material can be located in the opening between the material guide and the pawl; and wherein the pawl has a plurality of teeth to engage the hook and loop material to prevent the hook and loop material from moving backwards relative to the cutting mechanism.

6. The device of claim 5, wherein the pawl is pivotable to an open pawl position to allow the hook and loop material to move freely though the opening.

7. The device of claim 1, wherein there is clearance in the interior of the cutting mechanism for the hook and loop material to pass through freely as the carriage slides between the first position and the second position.

8. The device of claim 1, further comprising:

a roll support attached to the housing and configured to support the hook and loop material; and a roll cap removably attached to the roll support;

wherein the roll support is configured to allow the hook and loop material to rotate to dispense the hook and loop material.

9. The device of claim 1 wherein the hook and loop material passes through the interior of the cutting mechanism with the carriage in the first position and the second position.

10. The device of claim 1 wherein the housing comprises a pair of elongated channels, and the carriage comprises a pair of elongate ribs located on opposite sides of the carriage, each of the ribs slidably received in a corresponding one of the channels for guided movement relative to the housing.

* * * * *